US006354579B1

(12) United States Patent
Lawrence

(10) Patent No.: US 6,354,579 B1
(45) Date of Patent: Mar. 12, 2002

(54) VISE FOR HOLDING WORKPIECE

(76) Inventor: Raymond Lawrence, 18717 Parthenia St., Unit 5, Northridge, CA (US) 91324

( * ) Notice: Subject to any disclaimer, the term of this patent is extended or adjusted under 35 U.S.C. 154(b) by 0 days.

(21) Appl. No.: 09/596,654

(22) Filed: Jun. 19, 2000

(51) Int. Cl.[7] ..... B25B 1/00
(52) U.S. Cl. ..... 269/157; 269/254 R; 269/287
(58) Field of Search ..... 279/43.3, 2.02, 279/44; 269/157, 287, 48.1, 254 R

(56) References Cited

U.S. PATENT DOCUMENTS 3,107,523 A * 10/1963 Oliver et al. ..... 279/44

FOREIGN PATENT DOCUMENTS

CH 280907 * 5/1952 ..... 279/43.3

* cited by examiner

*Primary Examiner*—Robert C. Watson
(74) *Attorney, Agent, or Firm*—Freilich, Hornbaker & Rosen

(57) ABSTRACT

A vise suitable for securely holding a workpiece relative to a machine table. The vise is comprised of an integral block of readily machinable material, e.g., soft steel, aluminum, or plastic. A slot extends into the block from a top surface toward a lower base portion. First and second jaw members, spaced by the slot, extend upwardly from the base portion. The top surfaces of the jaw members can be machined to form a cavity for receiving a workpiece. The cavity is bounded by clamping surfaces, respectively formed on the jaw members, which preferably conform to the workpiece outer profile surface. An inwardly directed clamping force is applied to the jaw members to engage the clamping surfaces against the workpiece outer profile surface. The inwardly directed force is produced by a collar extending around the upper region of the jaw members and cooperating with a screw extending into a blind hole in the outer surface of one of the jaw members. By turning the screw inwardly, the jaw members and clamping surfaces are urged together to clamp against a workpiece in the cavity. The vise is also useful for clamping against the inner profile surface of a workpiece. To do this, the jaw members can be urged outwardly by a screw threaded through the first jaw member and extending across the slot to bear against the second jaw member. The vise is modular in that it is preferably used as part of an assembly of multiple vises to enable multiple workpieces to be concurrently processed.

10 Claims, 3 Drawing Sheets

100
10
80
22

VISE FOR HOLDING WORKPIECE

FIELD OF THE INVENTION

This invention relates generally to machine tools, e.g., vertical milling machines and more particularly to a modular vise configured to securely hold a workpiece while it is being machined. The invention also relates to an assembly of multiple vises for enabling multiple workpieces to be concurrently processed.

BACKGROUND OF THE INVENTION

In the use of vertical milling and other machine tools, it is necessary to securely hold a workpiece relative to a machine tool table in order to achieve precision cuts. It is common practice to mount the workpiece either by clamping it directly to the table or by clamping it in a vise and mounting the vise to the table. A conventional mill vise is sometimes equipped with soft steel or aluminum jaws instead of hardened steel jaws. These soft jaws can be readily machined to form a clamping surface which can conform to and engage a profile surface on the workpiece.

SUMMARY OF THE INVENTION

The present invention is directed to an improved cost effective vise suitable for securely holding a workpiece relative to a machine table. The vise is comprised of an integral block of readily machinable material, e.g., soft steel, aluminum, or plastic. A slot extends into the block from a top surface toward a lower base portion. First and second jaw members, spaced by the slot, extend upwardly from the base portion. The top surfaces of the jaw members can be machined to form a cavity for receiving a workpiece. The cavity is bounded by clamping surfaces, respectively formed on the jaw members, which preferably conform to the workpiece outer profile surface. An inwardly directed clamping force is applied to the jaw members to engage the clamping surfaces against the workpiece outer profile surface.

In accordance with a preferred embodiment of the invention, the inwardly directed force is produced by a collar extending around the upper region of the jaw members and cooperating with a screw extending into a blind hole in the outer surface of one of the jaw members. By turning the screw inwardly, the jaw members and clamping surfaces are urged together to clamp against a workpiece in the cavity.

In accordance with a further aspect of the preferred embodiment, a series of vertically spaced blind holes are provided in the jaw member outer surface for enabling the jaw members to be reused for multiple machining jobs. That is, after a job 1 cavity has exhausted its purpose, the top surfaces of the jaw members can be machined to form a new job 2 cavity. A lower blind hole would then typically be used with the collar to produce the inward clamping force.

A preferred vise in accordance with the invention is useful not only for clamping against the outer profile surface of a workpiece, but also for clamping against the inner profile surface of a workpiece. To do this, the jaw members can be urged outwardly by a screw threaded through the first jaw member and extending across the slot to bear against the second jaw member.

A vise in accordance with the invention is intended to be modular in that it is preferably used as part of an assembly of multiple vises to enable multiple workpieces to be concurrently processed. Thus, a preferred vise embodiment is configured for attachment to a subplate intended to carry an array of multiple vises. The subplate is intended for removable attachment to a machine tool table. In use, a machine operator would typically load workpieces into the array of vises on a first subplate assembly which would then be attached to the machine tool table. While the workpieces on the first assembly are being machined, the operator can load a second assembly to be ready for immediate attachment to the table after the machining operations on the first assembly have been completed.

DETAILED DESCRIPTION

Figure 1:
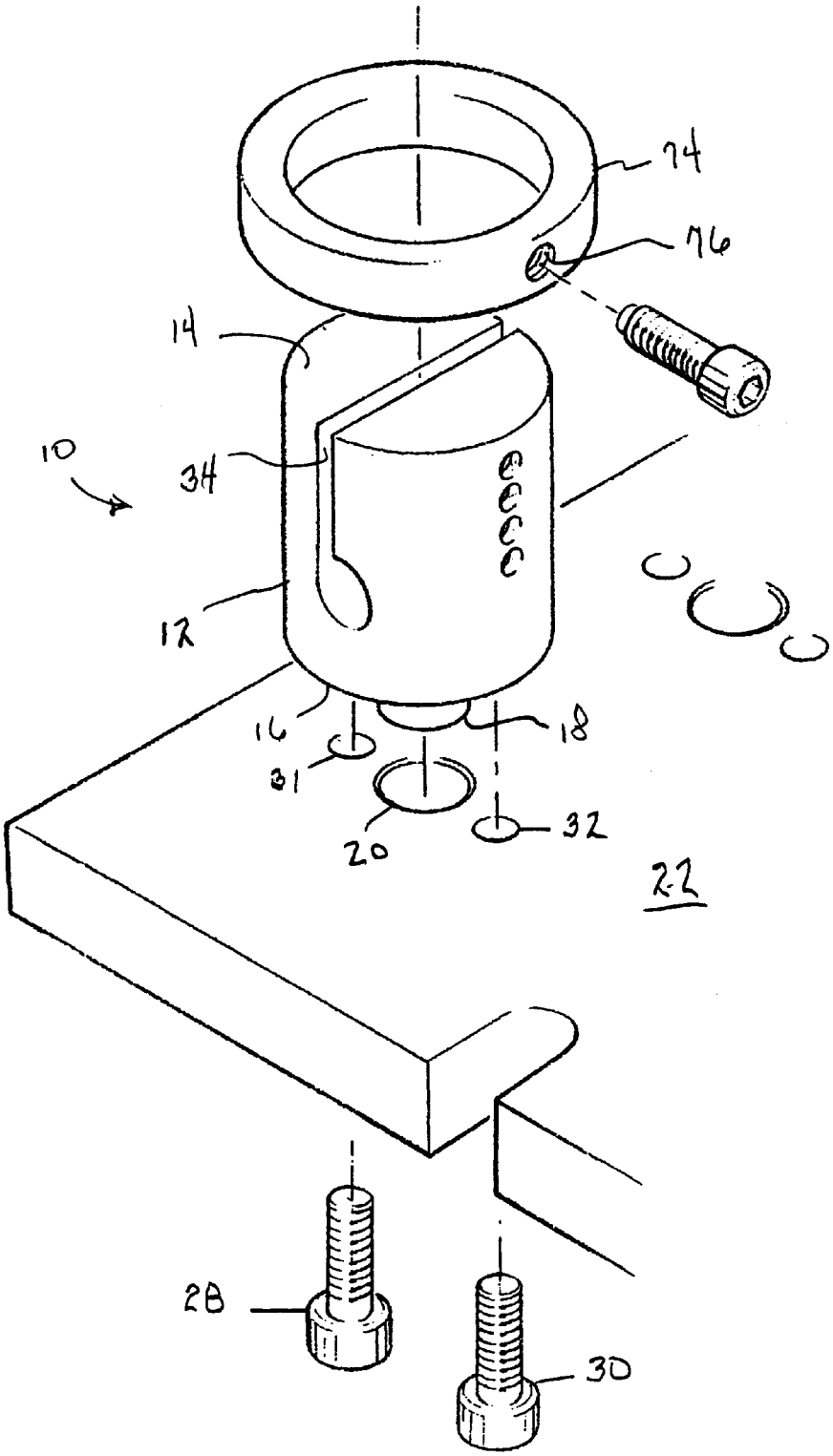
FIG. 1 is an isometric exploded view of a preferred embodiment of the invention depicted with respect to a machine tool table.

Attention is initially directed to FIGS. 1 and 2A, 2B, 2C which depict a preferred embodiment of a vise 10 in accordance with the present invention. The vise 10 is comprised primarily of an integral block 12 of a readily machinable material such as soft steel, aluminum, or plastic. The block 12 is depicted as having a circular cross-section, but it is recognized that the invention is also compatible with cylinders and prisms having noncircular cross-sections. The block 12 includes parallel, flat upper and lower surfaces 14, 16.

A positioning stud 18 preferably projects downwardly from the lower block surface 16. The stud 18 is intended to be received in a mating hole 20 formed in a plate 22 which could comprise a machine tool table but preferably comprises a subplate of an assembly of multiple vises 10 (FIG. 3) intended for removable attachment to the table. The lower block surface 16 also preferably defines threaded holes 24, 26 (FIG. 2A) for receiving mounting bolts 28, 30 extending through plate holes 31, 32 to secure the block 12 to the plate 22.

In accordance with the invention, a slot 34 is formed in the block 12 extending from the top surface 14 toward the lower surface 16. The slot 34 essentially segments the block 12 into a base portion 35 having first and second jaw members 36, 38 extending upwardly therefrom. First jaw member 36 defines a top surface 14A, an outer surface 39, and an inner surface 40 adjacent to slot 30. Similarly, the second jaw member 38 defines a top surface 14B, an outer surface 42, and an inner surface 44 adjacent to slot 30.

Note that in the preferred embodiment depicted, slot 34 does not form symmetric jaw members 36 and 38. Rather, the lower end of the slot is radiused at 50 and opens into relieved volume 52 projecting primarily into jaw member 38. This reduction in the cross section of jaw member 38 reduces it's torsional rigidity with respect to base portion 34.

Figure 2A:
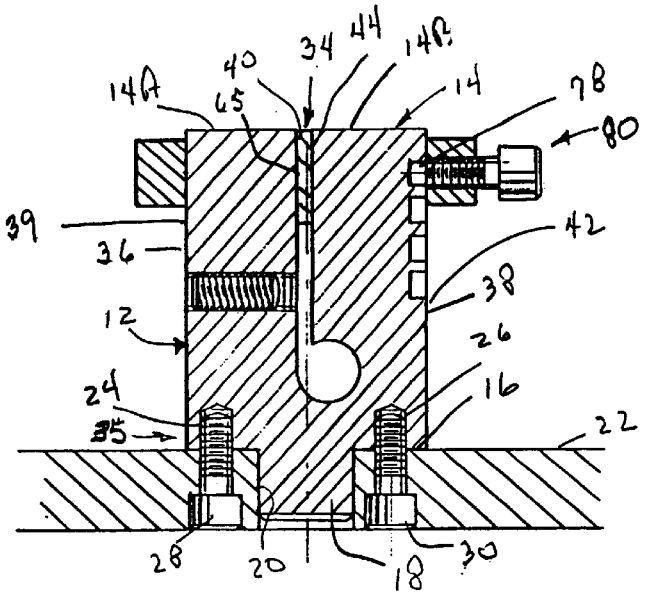
FIG. 2A is a sectional view of the embodiment to FIG. 1 attached to a flat plate, e.g., a machine tool table or intermediate plate.
Figure 2B:
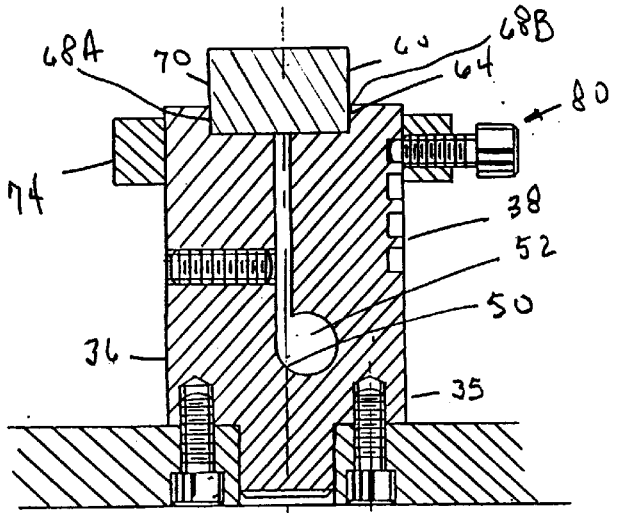
FIG. 2B is a sectional view similar to FIG. 2A but including a cavity for accommodating a workpiece and having clamping surfaces adapted to engage the outer profile surface of said workpiece.
Figure 2C:
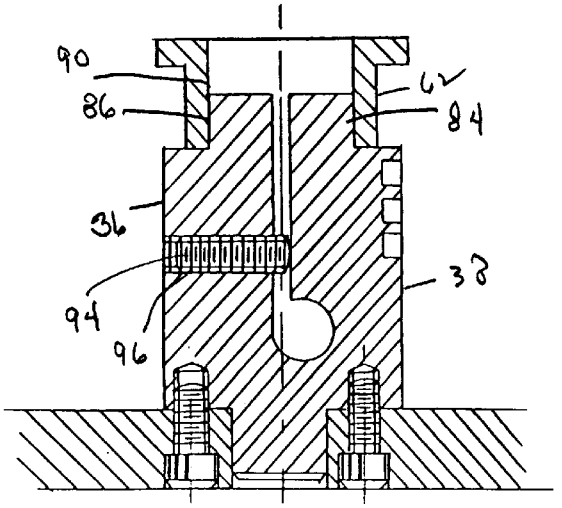
FIG. 2C is a sectional view similar to FIG. 2A but showing the upper region of the jaw members machined to engage the inner profile surface of a workpiece.

A vise 10 in accordance with the present invention is intended for clamping against either the outer profile surface of a workpiece 60 as depicted in FIG. 2B or the inner profile surface of a workpiece 62 as depicted in FIG. in 2C. More particularly, in use it is intended that a user first mill a cavity 64 in the top surfaces 14A, 14B of the jaw members 36, 38. This milling is preferably performed while a shim 65 is held between the jaw members 36, 38, clamped by collar 74, to maintain surfaces 40 and 44 parallel. The cavity 64 is shaped to accommodate the workpiece 60 and is preferably formed with opposed clamping surfaces 68A, 68B respectively formed on jaw members 36, 38 to conform to and engage the outer profile surface 70 of workpiece 60.

A collar 74 is provided for fitting around the outer surfaces 39, 42 of jaw members 36, 38. The collar is provided with an internally threaded hole 76 adapted to align with a blind hole 78 formed in the outer surface of jaw member 38. A screw 80 is intended to be threaded through hole 76 and extend into blind hole 78 for bearing against jaw member 38.

With the screw 80 initially turned out, the workpiece 60 is first placed in the cavity 64. The screw 80 is then turned inwardly to apply a clamping force acting to pull the jaw members 36, 38 together. This action urges the clamping surfaces 68A, 68B against the outer profile surface of the workpiece 60 to securely hold it.

It is intended that embodiments of the invention be reused for multiple jobs by machining the top surface of the jaw members. Thus, after a first cavity has served its purpose, the top surfaces of the jaw members can be machined to form a second different cavity. As the height of the jaw members is reduced, the clamping collar 74 must be moved downwardly. Accordingly, a plurality of blind holes 78 is preferably provided in the outer surface 42 of jaw member 38 to enable the collar to be lowered.

As previously mentioned, embodiments of the invention are useful not only for clamping the outer profile surface of a workpiece 60, as in FIG. 2B, but also for clamping the inner profile surface of a workpiece 62 as illustrated in 2C. Note in FIG. 2C that in lieu of forming a cavity in the top surfaces of the jaw members, the jaw members are machined to form a protuberance 84. This machining is preferably performed with shim 65 held in slot 34 and clamped by collar 74 held in a lowered position to afford adequate clearance to the upper region of the jaw members. The outer clamping surfaces 86, 87 of the protuberance formed by jaw members 36, 38 is preferably machined to conform to and engage the inner profile surface 90 of workpiece 62. The jaw members 36, 38 can be urged outwardly relative to one another by a screw 94 threaded into hole 96 extending radially through 36. Screw 94 extends through the hole 96 and is adapted to bear against inner surface 44 of jaw member 38 to urge the jaw members apart.

Figure 3:
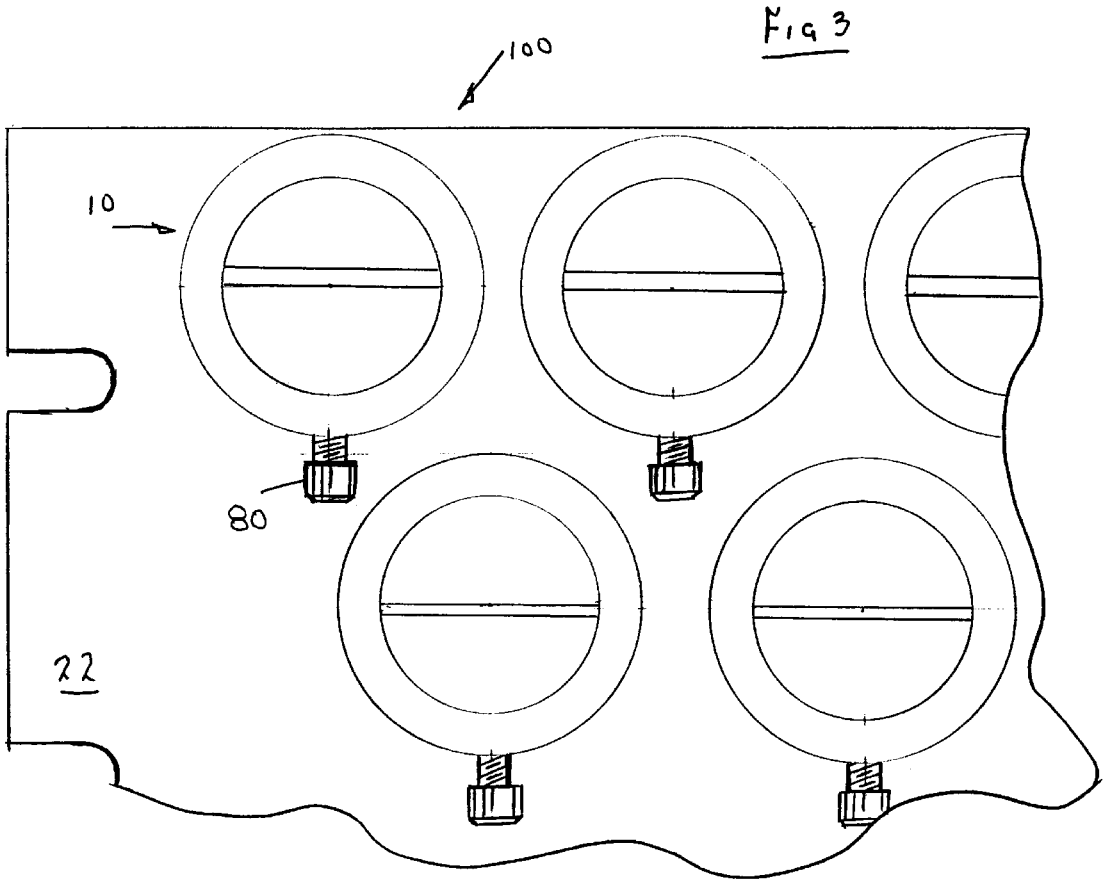
FIG. 3 is a plan view of an assembly of multiple vises in accordance with the present invention.

FIG. 3 shows an assembly 100 of multiple vises 10 mounted to a plate 22. The assembly is intended to be mounted as a unit on a machine tool table to enable multiple workpieces to be concurrently processed.

From the foregoing, it should now be appreciated that a vise has been described herein comprised of an integral block of readily machinable material having first and second jaw members which can be selectively urged toward one another to clamp the outer profile surface of a workpiece or away from one another to clamp the inner profile surface of a workpiece. Embodiments of the invention are formed of readily machinable material enabling them to be reformed to accommodate successive work pieces. Thus, vises in accordance with the invention provide a cost effective readily usable device for holding a workpiece relative to a machine table. Moreover, vises in accordance with the invention can be readily used in an assembly of multiple vises for concurrently processing multiple workpieces.

Vises in accordance with the invention can be provided in a very wide range of sizes. Without intending to in any manner restrict the scope of the invention, it is mentioned that one exemplary embodiment can be dimensioned substantially as follows:

block diameter from 1 to 3 inches:

block height approximately equal to diameter;

slot width approximately one-eighth inch

Although a specific preferred embodiment of the invention has been described, it is recognized that variations and alternatives may readily occur to those skilled in the art. It is accordingly intended that the appended claims be interpreted to include all alternatives and equivalents falling within the spirit of the invention.

What is claimed is:

1. A vise suitable for holding a workpiece, said vise comprising:

an integral block having a top surface and a bottom surface;

a slot formed in said block extending from said top surface toward said bottom surface to define first and second jaw members projecting from a base member;

a rigid collar configured to engage the outer surface of said first jaw member;

a screw threaded through said collar and bearing against the outer surface of said second jaw member to urge said jaw members together; and wherein said screw extends into a blind hole formed in said second jaw member outer surface.

2. The vise of claim 1 wherein said block is formed of a material which can be readily machined to form a cavity in said top surface to accommodate a workpiece.

3. The vise of claim 1 wherein said second jaw member outer surface defines a plurality of aligned blind holes, and wherein said screw extends into one of said blind holes to bear against said second jaw member outer surface.

4. The vise of claim 1 wherein said slot is configured to define nonsymmetric first and second jaw members.

5. The vise of claim 1 including a means formed in said bottom surface for securing said block to a machine tool table.

6. A vise suitable for selectively clamping against an inner or outer profile surface of a workpiece, said vise comprising:

an integral block comprising a base portion and first and second jaw members projecting perpendicularly from said base portion;

said first and second jaw members defining opposed interior surfaces spaced by a slot extending through said block;

each of said first and second jaw members defining a top surface extending substantially perpendicular to said slot and an outer surface oriented substantially perpendicular to said top surface;

said jaw members being formed of a material which can be readily machined to form clamping surfaces adapted to conform to and engage either said inner or outer workpiece profile surfaces; and means for applying a force to said jaw members directed substantially perpendicular to said slot to selectively urge said jaw members together to engage an outer profile surface of said workpiece or urge said jaw members apart to engage an inner profile surface of said workpiece.

7. The vise of claim 6 wherein said means for applying a force to urge said jaw members together includes;

a rigid collar configured to engage the outer surface of said first jaw member; and a screw threaded through said collar and bearing against said second jaw member outer surface.

8. The vise of claim 7 wherein said screw extends into a blind hole formed in said second jaw outer surface.

9. The vise of claim 7 wherein said second jaw outer surface defines a plurality of aligned blind holes, and wherein said screw extends into one of said blind holes to bear against said second jaw outer surface.

10. The vise of claim 6 wherein said means for applying a force to urge said jaw members apart includes:

a screw extending through one of said jaw members substantially perpendicular to said slot and engaging the interior surface of the other of said jaw members.

* * * * *